US008403578B2

(12) United States Patent
Burhans

(10) Patent No.: US 8,403,578 B2
(45) Date of Patent: Mar. 26, 2013

(54) PORTABLE DISHWASHING APPARATUS

(76) Inventor: David Burhans, Jupiter, FL (US)

( * ) Notice: Subject to any disclaimer, the term of this patent is extended or adjusted under 35 U.S.C. 154(b) by 0 days.

(21) Appl. No.: 12/924,512

(22) Filed: Sep. 29, 2010

(65) Prior Publication Data

US 2012/0076567 A1 Mar. 29, 2012

(51) Int. Cl.
*A47L 13/12* (2006.01)
*A46B 11/06* (2006.01)
*A46B 11/08* (2006.01)

(52) U.S. Cl. ..... 401/43; 401/16; 401/27; 401/34; 401/36; 401/40

(58) Field of Classification Search ..... 401/1, 23, 401/35, 39, 40, 43, 16, 24, 27, 34, 36, 41, 401/42; 15/111
See application file for complete search history.

(56) References Cited

U.S. PATENT DOCUMENTS 745,406 A * 12/1903 LaBonte ..... 401/43
2,266,902 A * 12/1941 Perkins ..... 401/43
2,514,225 A 7/1950 Dabrohua
2,540,064 A 1/1951 Weber
2,545,110 A 3/1951 Schaar et al.
2,772,430 A * 12/1956 Moritt ..... 401/151
2,876,040 A 3/1959 De Simone et al.
2,975,804 A 3/1961 Dunn et al.
3,163,880 A * 1/1965 Johnson ..... 401/1
3,989,391 A * 11/1976 Thorner ..... 401/43
4,171,169 A 10/1979 Williams
4,542,756 A 9/1985 Gibson
4,618,279 A * 10/1986 Gurevich et al. ..... 401/36
4,638,826 A 1/1987 Canosa
4,804,006 A 2/1989 Shaw
5,518,014 A 5/1996 McEachen
6,092,540 A 7/2000 Chiao
6,959,460 B2 * 11/2005 Patterson ..... 4/625

* cited by examiner

*Primary Examiner* — David Walczak
*Assistant Examiner* — Bradley Oliver
(74) *Attorney, Agent, or Firm* — Robert M. Downey, P.A.

(57) ABSTRACT

A portable dishwashing apparatus is easily transportable, requires a minimal amount of water, and allows for quick and easy cleansing of dishes and utensils. A base unit in communication with a water source encases both a water heater unit and a soap mixture tank. In one embodiment, the water source is a portable water holding tank. A hand unit in connection with the base unit includes a handle having a rinse extension bar and a cleaning head extension bar extending outwardly. A soap mixture exits the distal end of the cleaning head extension bar onto a cleaning head, which is used to scrub dishes. A trigger located on the hand unit controls the flow of water from the distal end of the rinse extension bar and the distal end of the cleaning head extension bar. A portable sink unit supports the base unit and water holding tank, and further includes a drain for transporting excess soap and water runoff to a used water holding tank.

20 Claims, 10 Drawing Sheets

PORTABLE DISHWASHING APPARATUS

BACKGROUND OF THE INVENTION

1. Field of the Invention

The present invention relates to a dishwashing apparatus and, more particularly, to a portable dishwashing apparatus having a base unit and an accompanying hand unit that allows for easy, one-handed operation of the dishwashing apparatus, and requires a minimal amount of water, which can be accessed from direct hook up to plumbing or from within its own contained water supply.

2. Discussion of the Related Art

Over the years, automatic dishwashers have become commonplace in households in the United States, and provide a convenient method of cleaning and sterilizing dishes and eating utensils. Typically, dirty dishes are loaded into the dishwasher, which, in operation, sprays heated water at 130-150 degrees Fahrenheit onto the dishes. A detergent and water mixture is then used to clean the dishes, followed by clean water to remove the detergent residue. While such represents the typical dishwashing cycle process in both residential and commercial dishwashers alike, a number of advances have been made in recent years in an effort to further enhance the cleansing capabilities of dishwashers, such as the use of multiple wash and rinse cycle periods as well as the inclusion of rinsing aids.

A considerable drawback of traditional automatic dishwashers is the large amount of water required during each wash and rinse cycle. Such a negative characteristic becomes readily apparent when an automatic dishwasher is used when it is not filled to full capacity, which is likely to occur in households of one to three persons. Furthermore, a number of situations may present themselves to an individual who may have dirty dishes but is in a location lacking a automatic dishwasher. For example, a college dorm room rarely comes equipped with a automatic dishwasher, however, college students often utilize micro-refrigerators that include an attached microwave, which is used to heat entire meals. Consequently, college students must either purchase disposable paper plates and plastic eating utensils or engage in the cumbersome task of hand washing the dirty dishes.

Only a few dishwashing devices have been developed that can be used in a portable fashion. A number of these portable dishwashing devices are non-electric, and are powered by water pressure alone. For example, U.S. Pat. No. 4,542,756 discloses a portable non-electric dishwasher system that is especially suited for insertion within a sink and includes an enclosed dish-holding container, and is entirely reliant on the water pressure supplied by an outside source. Suspended throughout the interior of the enclosure is a series of expansible water bladders having multiple apertures for spraying water on the dirty dishes. With the application of the pressurized water, the bladders expand, which effectively scrubs the dirty dishes. The continued expansion of the bladders eventually triggers an outflush of water from the apertures, thus rinsing the dirty dishes. This scrub and rinse cycle continues over a period of time as determined by the user.

U.S. Pat. No. 5,518,014 discloses a portable countertop dishwasher that is electrically powered and structured for placement alongside a sink. The portable countertop dishwasher includes a housing cavity with a fluid handling assembly contained therein and having an upper pump and a lower pump, each within its own housing. In operation, the pumps distribute fluid amongst the dishes within the housing cavity, with an outlet conduit serving to release the fluid from the housing.

While the portable dishwashing devices described above are useful for their intended purpose, there remains a need for a more practical and efficient electrically powered portable dishwashing apparatus that is easily transportable, requires a minimal amount of water, and allows for quick and easy cleansing of dirty dishes. The present invention seeks to address the limitations and shortcomings of presently known portable dishwashing devices, as well as to effectively minimize the amount of water that is wasted during the cleansing process.

The present invention provides a portable dishwashing apparatus that includes a base unit having means to heat water that is supplied from a conventional plumbing system via attachment or, alternatively, supplied from a portable water holding tank in connection with the base unit. The present invention utilizes a hand unit having a cleaning head that is in connection with the base unit's heated water supply, and is equipped to brush, scrape, and wash dishes and utensils.

OBJECTS AND ADVANTAGES OF THE INVENTION

Considering the foregoing, it is a primary object of the present invention to provide a portable dishwashing apparatus that allows for easy, one handed operation while using a minimal amount of hot water within a selectively controllable temperature range in order to wash dishes, glasses cups, eating utensils, pots, pans and the like, on an as needed basis.

It is a further object of the present invention to provide a portable dishwashing apparatus that allows for fast and easy dishwashing, and that is ready to use, on demand.

It is still a further object of the present invention to provide a portable dishwashing apparatus that does not hook up to a sink faucet, thereby allowing the sink and faucet to remain free for normal use.

It is still a further object of the present invention to provide a portable dishwashing apparatus which is adapted to clean one dish in a matter of seconds with no wasted water and considerably less energy uses as compared to other conventional dishwashing systems and methods.

It is still a further object of the present invention to provide a portable dishwashing apparatus that provides hot water in a matter of seconds, with no water wasted while waiting for the water to heat to the desired temperature, and further wherein the apparatus is able to maintain a selected water temperature throughout use.

It is yet a further object of the present invention to provide a portable dishwashing apparatus that is adapted to soap and rinse at the same time, thereby saving time, energy and water.

It is still a further object of the present invention to provide a portable dishwashing apparatus that is structured to direct hot water directly into a cleaning head while helping to keep food and germs out of the cleaning head.

It is still a further object of the present invention to provide a portable dishwashing apparatus that provides a pivotable and rotatable cleaning head that receives a flow of hot water and soap mixture, and wherein the cleaning head surface remains hot even when turned upside down.

It is still a further object of the present invention to provide a portable dishwashing apparatus that provides a hand unit with a cleaning head and a rinse extension arm, and wherein the rinse extension arm is structured and disposed to be used for holding the cleaning head in position.

It is yet a further object of the present invention to provide a portable dishwashing apparatus as set forth above, and wherein the cleaning head is structured and disposed for wiping, scraping and scrubbing dishes, pots, pans and the like.

These and other objects and advantages of the present invention are more readily apparent with reference to the detailed description and accompanying drawings.

SUMMARY OF THE INVENTION

The present invention is directed to a portable dishwashing apparatus that is easily transportable, requires a minimal amount of water, and allows for quick and easy cleansing of dishes. The portable dishwashing apparatus includes a base unit having means to heat water that is supplied from a conventional plumbing system or other water flow supply source via attachment or, alternatively, supplied from a portable water holding tank in connection with the base unit. The water, whether supplied via a conventional plumbing system, other water flow supply source or from the portable water holding tank, is heated by a heater unit located within the base unit. A soap mixture tank containing heavily concentrated soap is located within the base unit of the portable dishwashing apparatus, and serves to mix and store the heated water and concentrated soap mixture. The present invention utilizes a hand unit having a cleaning head that is in connection with the base unit's heated water supply and soap mixture tank, and is equipped to brush, scrape, and wipe dish surfaces, and to further apply the heated water and soap mixture in order to wash dishes and utensils. The hand unit also provides a clean and rinse function to rinse the soapy water from the cleaned dishes and utensils.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENTS

Referring to the several views of the drawings, the portable dishwashing apparatus that is easily transportable, requires a minimal amount of water, and allows for quick and easy cleansing of dishes is shown according to the several embodiments of the invention and is generally indicated as 10.

Figure 2:
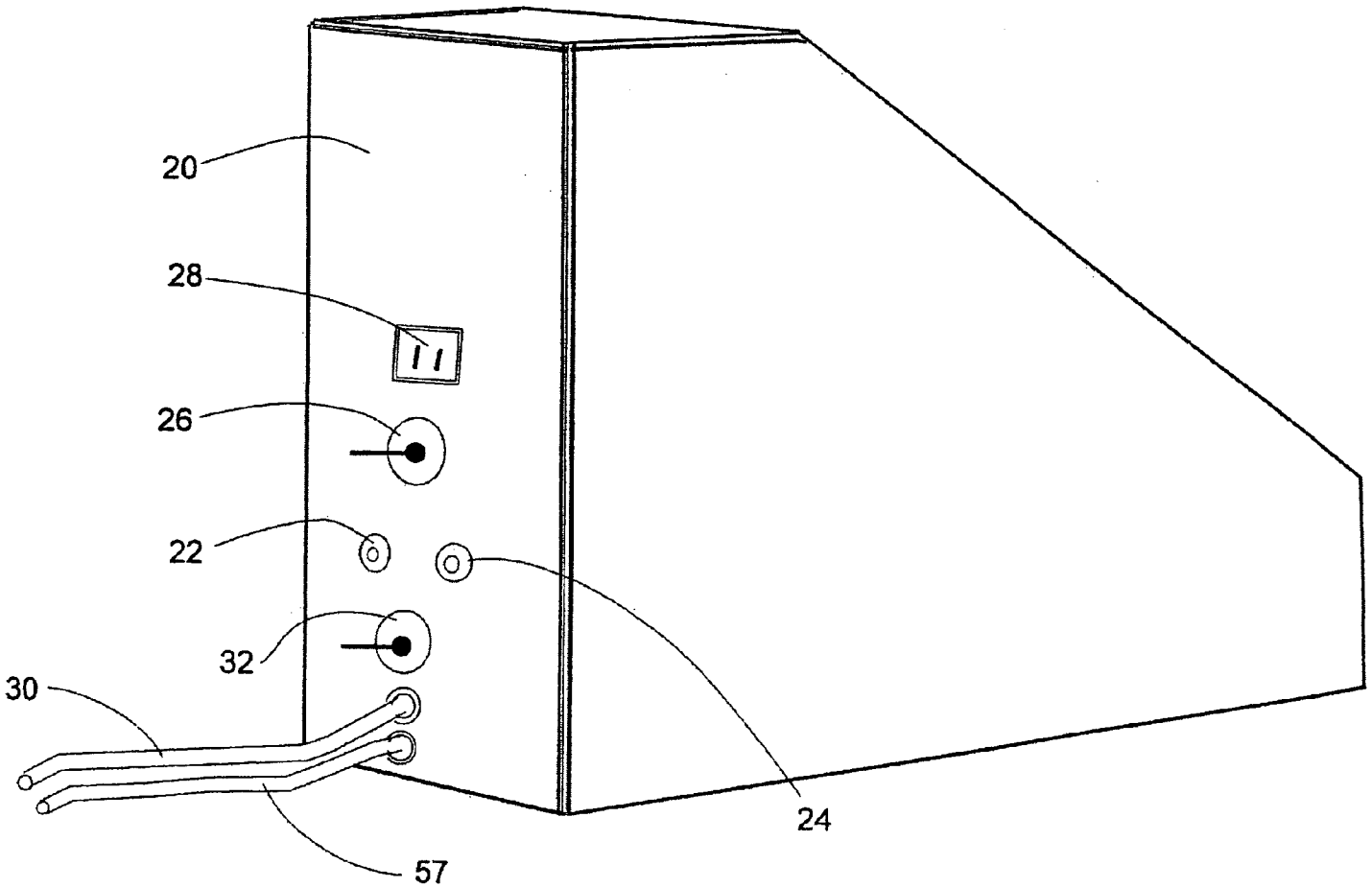
FIG. 2 is a perspective view of the base unit showing a direct water supply inlet connection, a holding tank water inlet connection, a receptacle for the water holding tank, a water inlet valve knob, a drain tube, and a drain tube valve knob.

In each of the embodiments of the invention, the portable dishwashing apparatus 10 includes a base unit 20 and a hand unit 60. Referring to FIG. 2, the rear panel of the base unit 20 includes a direct water supply inlet connection 22 and a holding tank water inlet connection 24, providing the user with the option of using a conventional plumbing system or other water flow supply as a water source or, alternatively, a portable water holding tank 110 as a source of water. A water inlet valve knob 26 controls whether the base unit 20 receives water via the direct water supply inlet connection 22 or the holding tank water inlet connection 24. For use in conjunction with the portable water holding tank 110, a holding tank receptacle outlet 28 is provided for receipt of the water pump plug 112 of the portable water holding tank 110. A soap drain tube 30 is provided to empty the soap mixture tank 158 that is located within the base unit 20. A drain tube valve knob 32 controls the exit of the soap mixture 162 via the soap drain tube 30. Lastly, a base unit overflow tube 57 serves to drain the base unit 20 in the event of an internal leak.

Figure 1:
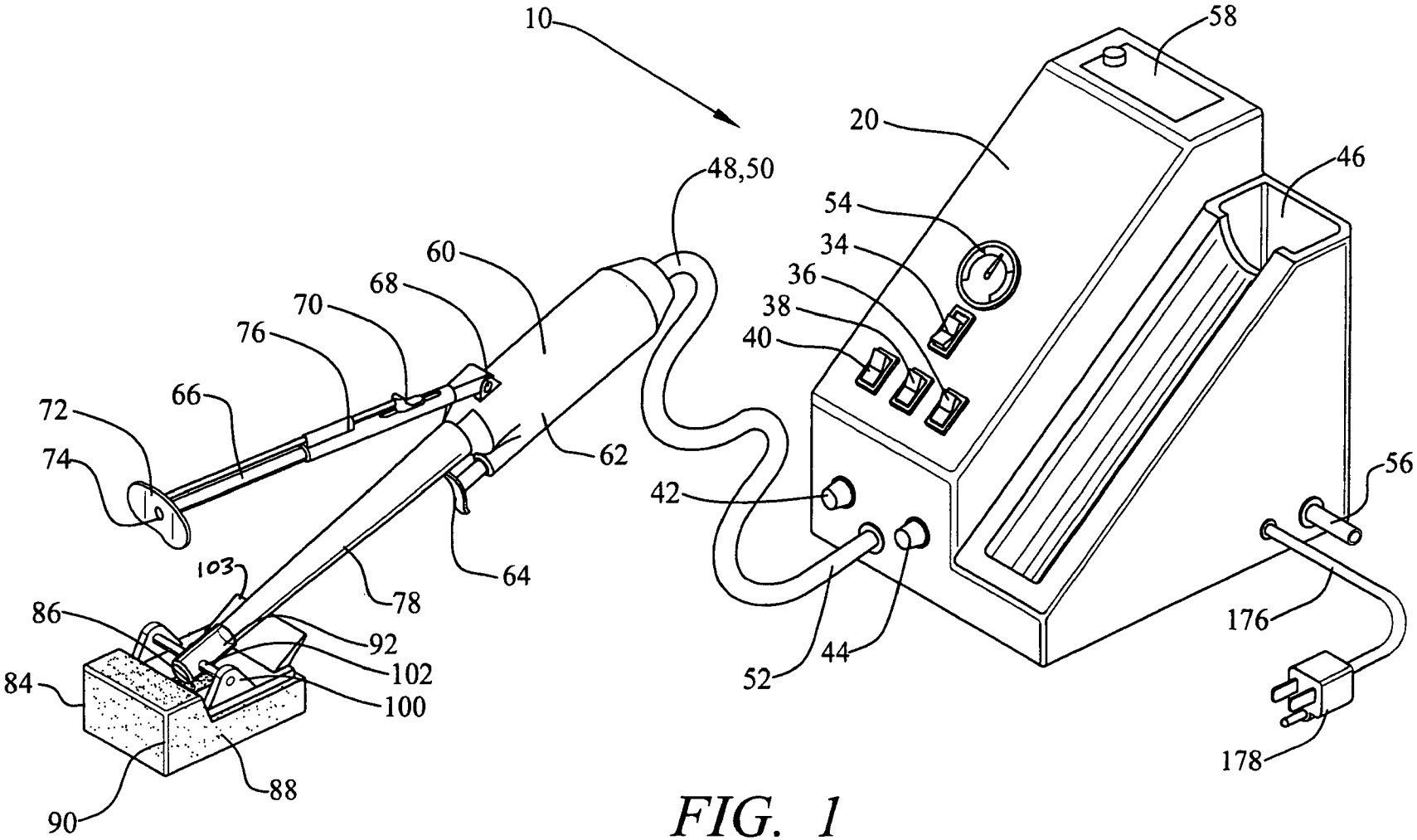
FIG. 1 is a perspective view showing the portable dishwashing apparatus of the present invention, in accordance with one embodiment, and including a base unit with a thermometer for displaying the temperature of the water in the heater unit within the base unit, a set of controls for controlling the operations of the apparatus, and a storage compartment for an accompanying hand unit, and a tube separately encasing a soap line and a hot water line, and the tube connecting the hand unit with the base unit.

Referring to FIG. 1, the top side of the base unit 20 includes a thermometer display 54 for indicating the temperature of the water exiting a heater unit 142 located within the base unit 20. A set of controls for controlling the operations of the portable dishwashing apparatus 10 is further included on the top side of the base unit 20, including: a heater unit control knob 34 for controlling the temperature of the heater unit 142, a water holding unit pump knob 36, a heater unit power knob 38, a water toggle switch 40, a pressure reducer control knob 42, and a soap adjustment knob 44. A storage compartment 46 for the accompanying hand unit 60 is provided that also serves to catch any water run-off from the hand unit 60 after being used. A hand unit drain tube 56 extends outwards from the base unit 20 for draining the excess water run-off within the storage compartment 46. A soap unit compartment 58 located on the base unit 20 can be opened to access the soap mixture tank 158. Extending from the front side of the base unit 20 are a hand unit soap line 48 and a hand unit water line 50 that connect the base unit 20 with the hand unit 60. Encasing the hand unit soap line 48 and the hand unit water line 50 is a hand unit connector tube 52.

Figure 3:
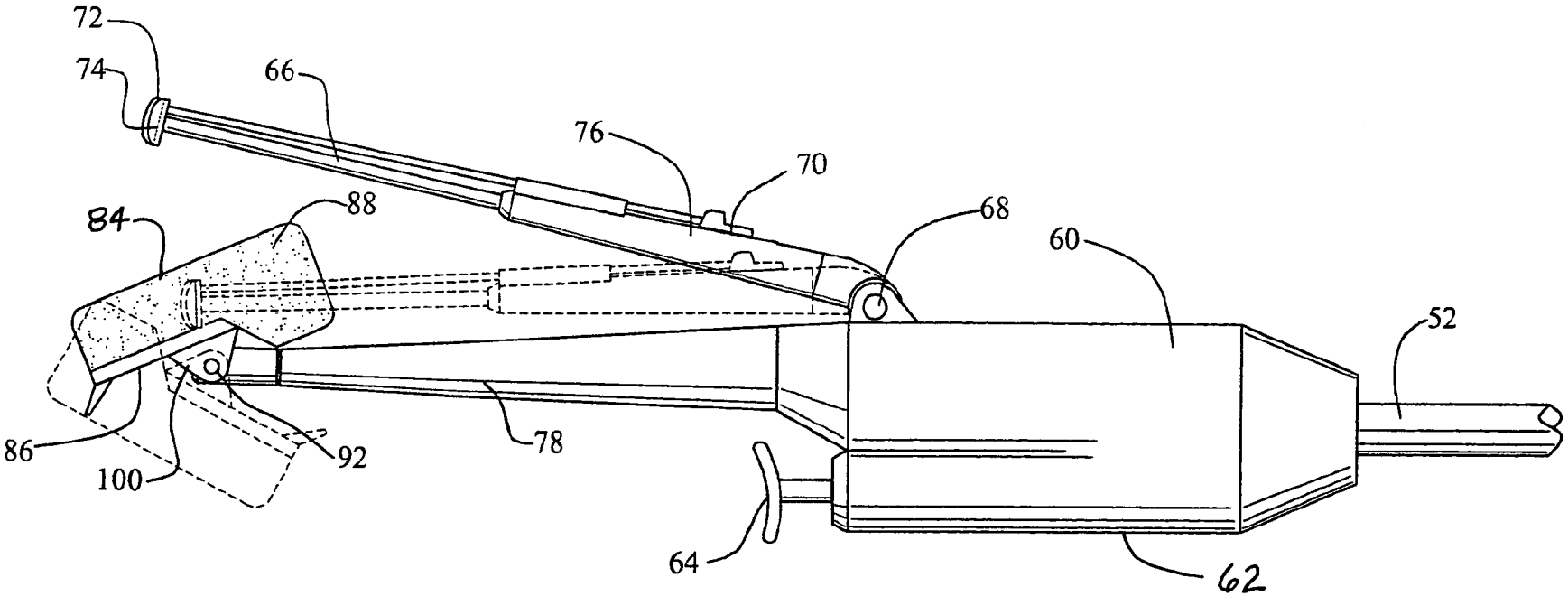
FIG. 3 is a side view of the hand unit showing a rinse extension bar, a scraper, a rinse tube water exit, a thumb grip, a swivel pin for allowing pivoting of the rinse extension bar, a cleaning head extension, a cleaning head base with a filter or sponge material optionally enclosed by fabric, a trigger for operation of the hand unit, and a tube encasing the soap line and the hot water line.

Referring to FIG. 3, the hand unit 60 is ergonomically structured for being grasped within a user's hand in a position that allows the user's forefinger to depress the trigger 64. The hand unit 60 includes a rinse extension bar chamber 76 that slideably captivates a rinse extension bar 66 that extends outwardly from the distal end of the rinse extension bar having chamber 76. A pivot pin 68 connects the rinse extension bar chamber 76 with the handle 62 of the hand unit 60 and allows for guided, pivoting movement of the rinse extension bar 66 and chamber 76 about the pin 68 and relative to the cleaning head extension bar 78 so that the rinse extension bar 66 can be moved towards the cleaning head extension bar 78 to hold the cleaning head 84 while scrubbing and scraping (see broken line illustration in FIG. 3). A spring 77 at the swivel pin 68 urges the rinse extension bar 66 to a relaxed position shown in FIGS. 4 and 5. A thumb grip 70 is ergonomically placed along the rinse extension bar 66 to allow the user to easily extend the rinse extension bar 66 outwardly relative to the chamber 76 by applying pressure to the thumb grip 70. At the distal end of the rinse extension bar 66 is a scraper 72 that can be used to scrape dirty dishes during the cleaning process. A rinse tube water exit 74 is also located at the distal end of the rinse extension bar 66. The rinse extension bar 66 can extend out from and retract within the rinse extension bar chamber 76 to accommodate the user's needs.

Figure 7:
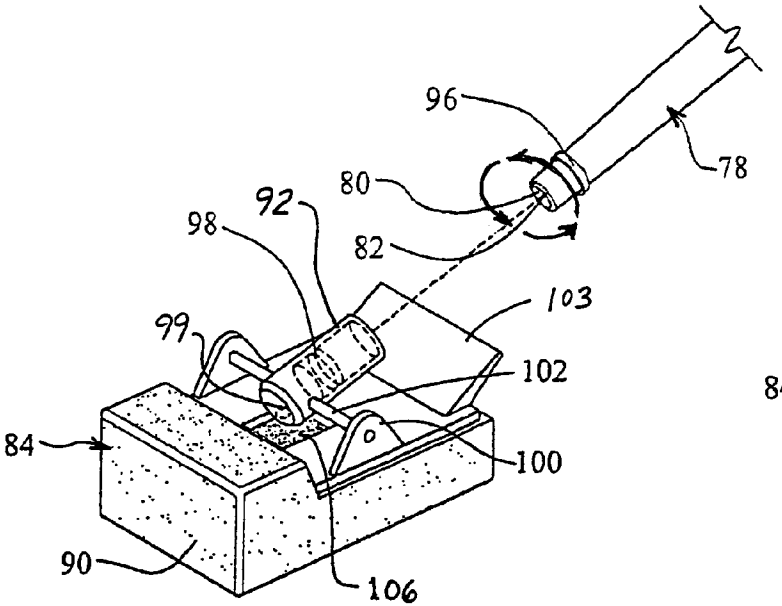
FIG. 7 is an isolated perspective view of the cleaning head, in accordance with a preferred embodiment, showing an cleaning head extension bar with a first reduced hole for the soap mixture to exit the cleaning head and a second reduced hole for the hot water to exit the cleaning head, a male ring for snap-on attached engagement within a female receptacle of the cleaning head, a cleaning head base with associated filter or sponge material covered with an optional fabric, and further illustrating rotational movement of the male fitting on the end of the extension bar relative to the female receptacle, thereby allowing 360 degree rotation of the cleaning head.

Also extending from the handle 62 of the hand unit 60 is a cleaning head extension bar 78. Located at the distal end of the cleaning head extension bar 78 is a first reduced hole 80 for the soap mixture 162 to exit and a second reduced hole 82 for the hot water to exit, as shown in FIG. 7. A cleaning head 84 attaches to the distal end of the cleaning head extension bar 78, which includes a cleaning head base 86 and a filter or sponge material 88 suitable for scrubbing dishes. An optimal fabric 90 covers the filter or sponge material 88. Additionally, the cleaning head extension bar 78 and the rinse extension bar 66 can be moved together, as illustrated by the broken lines in FIG. 3, allowing the user to reach narrow areas while cleaning. Multiple embodiments of the cleaning head 84 are contemplated, each of which can be interchangeably attached to the cleaning head extension bar 78, providing the user with a variety of cleaning options.

Figure 8:
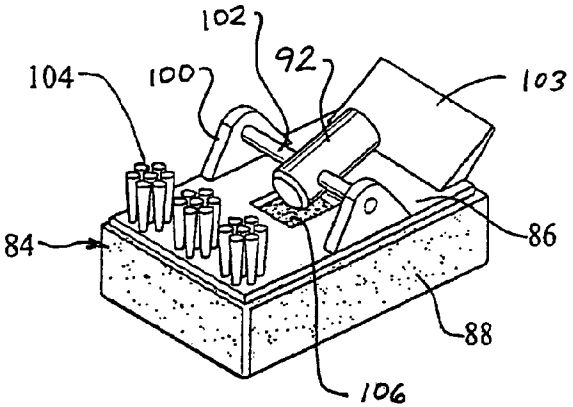
FIG. 8 is an isolated perspective view of the cleaning head, in accordance with another embodiment, showing a female receptacle of the cleaning head, a cleaning head base with associated filter or sponge material, and a grouping of rubber brush bristles.
Figure 9:
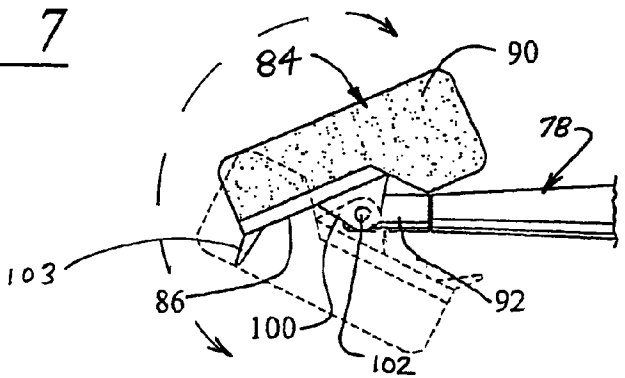
FIG. 9 is an isolated side view illustrating a range of pivoting movement of the cleaning head about a pivot pin relative to the distal end of the extension bar.

Referring to FIGS. 7-9, the structure of the cleaning head 84 and its method of attachment to the cleaning head extension bar 78 is shown in accordance with a preferred embodiment. In the embodiment shown in FIGS. 7-9, the cleaning head extension bar 78 includes a male snap-on attachment component 96, generally in the form of a ring, that engages a female snap-on attachment component 98, generally in the form of an annular groove, within female receptacle 92. The receptacle 92 is rotatably held on a swivel rod component 100, allowing the cleaning head 84 to rotate about the swivel rod axis 102, as indicated by the arrows in FIG. 9. A hole 99 in the female receptacle 98 (see FIG. 7) directs the flow of hot water and soap into the filter material (or spongy material) exposed within square opening 106 of the cleaning head base 86.

Several embodiments of the cleaning head 84 are contemplated within the scope of the invention. The cleaning head 84 illustrated in FIGS. 7 and 9 includes the cleaning head base 86 with an integrally formed scraper 103, the array of rubber brush bristles 104 (see FIG. 8), and the filter or sponge material 88 with the filter or sponge material and bristles covered by the optional fabric 90. Another embodiment of the cleaning head 84 is illustrated in FIG. 8 and includes an array of rubber brush bristles 104 attached to the cleaning head base 86, and the filter or sponge material 88, but without the optional fabric.

Figure 6:
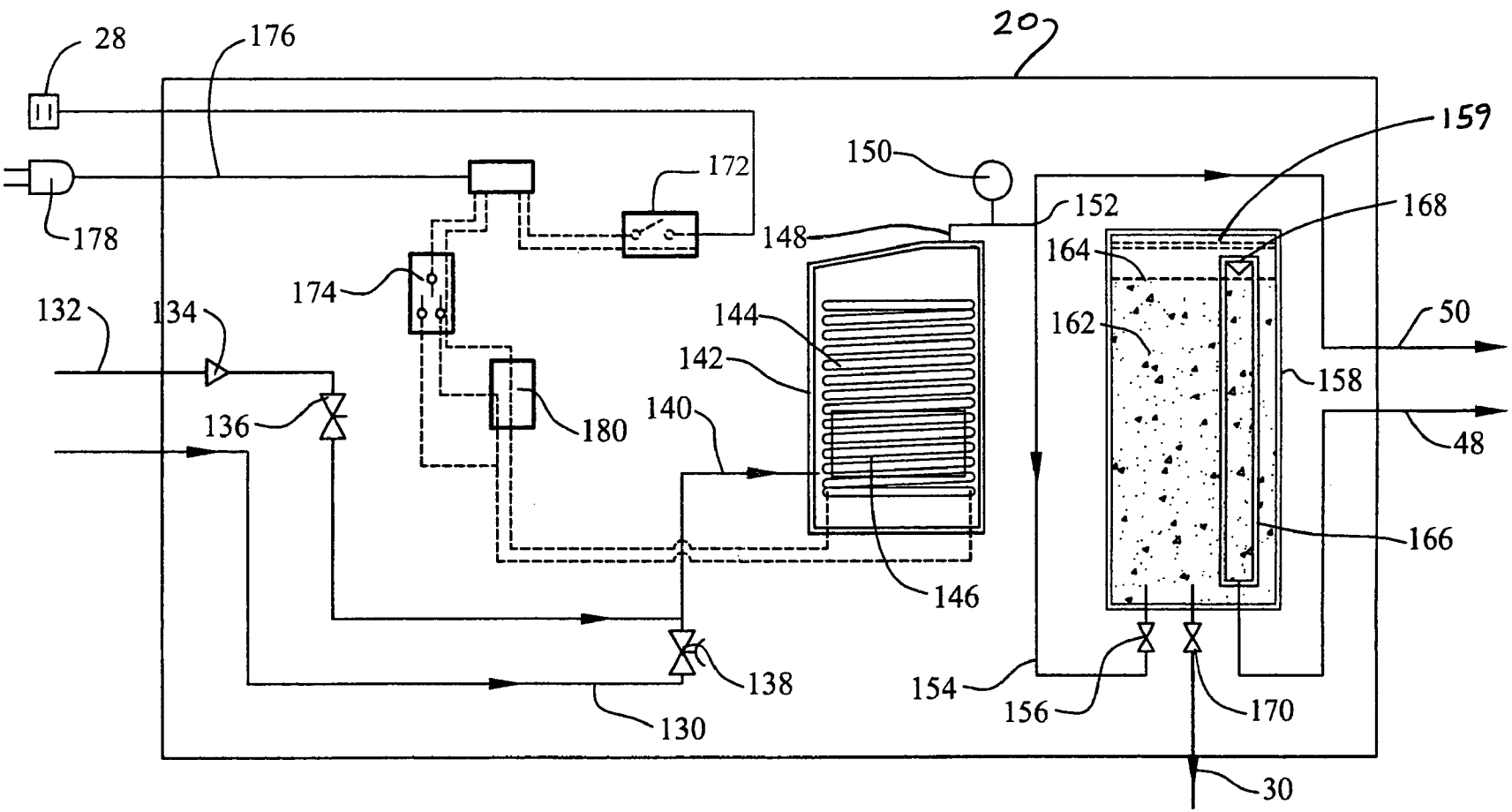
FIG. 6 is a schematic illustration of the base unit of the present invention, showing a heater unit and a soap mixture tank enclosed therein, as well as the flow of water through the base unit.

In operation, a water source is provided by the holding tank inlet tube 130 extending from the portable water holding tank 110, which is plugged into the holding tank water inlet connection 24. Additionally, or in the alternative, the direct line inlet tube 132 can be connected to a conventional plumbing system at the direct water supply inlet connection 22 to serve as a water source. Referring to FIG. 6, water from the direct line inlet tube 132 is directed to a pressure reducer 134, which the user controls with the pressure reducer control knob 42. The water from the direct line inlet tube 132 subsequently flows to the water toggle 136, which the user controls with the water toggle switch 40 located on the base unit 20.

The holding tank inlet tube 130 and the direct line inlet tube 132 converge at a valve 138, which controls whether water is received from the holding tank inlet tube 130 or the direct line inlet tube 132. The user controls the valve 138 with the water inlet valve knob 26 located on the base unit 20. Thereafter, the water flows in a cold water line 140 from the valve 138 to the heater unit 142. The water enters the heater unit 142 and is heated by the heater coils 144. A filter material 146 helps to even the flow of water through the heater. The water then exits the heater unit 142 via the hot water exit tube 148, where a thermometer 150 calculates the temperature of the water. The thermometer display 54 located on the base unit 20 displays the temperature calculated by the thermometer 150 to the user.

The hot water exit tube 148 then flows to a T-splitter 152, which splits the water into two separate lines—the hand unit water line 50 and the soap tank water line 154. The hand unit water line 50 travels directly out of the base unit 20 and enters the hand unit connector tube 52. The soap tank water line 154 approaches a soap tank valve 156, which controls the amount of water that enters the soap mixture tank 158. The soap tank valve 156 is controlled by the soap adjustment knob 44 located on the base unit 20. The water enters the soap mixture tank 158 and comes into contact with a soap concentrate, forming a soap mixture 162. The user can access the soap mixture tank 158 and replace the soap concentrate by opening the soap unit compartment 58 located on the base unit 20 and removing a cap 159 on the top of the soap mixture tank 158. Once the mixture tank 158 is filled with soap concentrate to the appropriate replacement level, the cap 159 is replaced and the compartment is closed. As more water enters the soap mixture tank 158, the level of the soap mixture 162 rises until reaching a soap fill level 164, at which point the soap mixture 162 begins to enter a soap exit tube 166, which is located within the soap mixture tank 158, through a V-cut 168 at the top of the soap exit tube 166. The soap mixture 162 then enters the hand unit soap line 48, which exits the base unit 20 and enters the hand unit connector tube 52. A soap drain valve 170 can be opened to release (i.e. drain) excess soap mixture 162 from the soap mixture tank 158 via a soap drain tube 30 that leads to a sink exit tube 193 (see FIG. 10).

Figure 4:
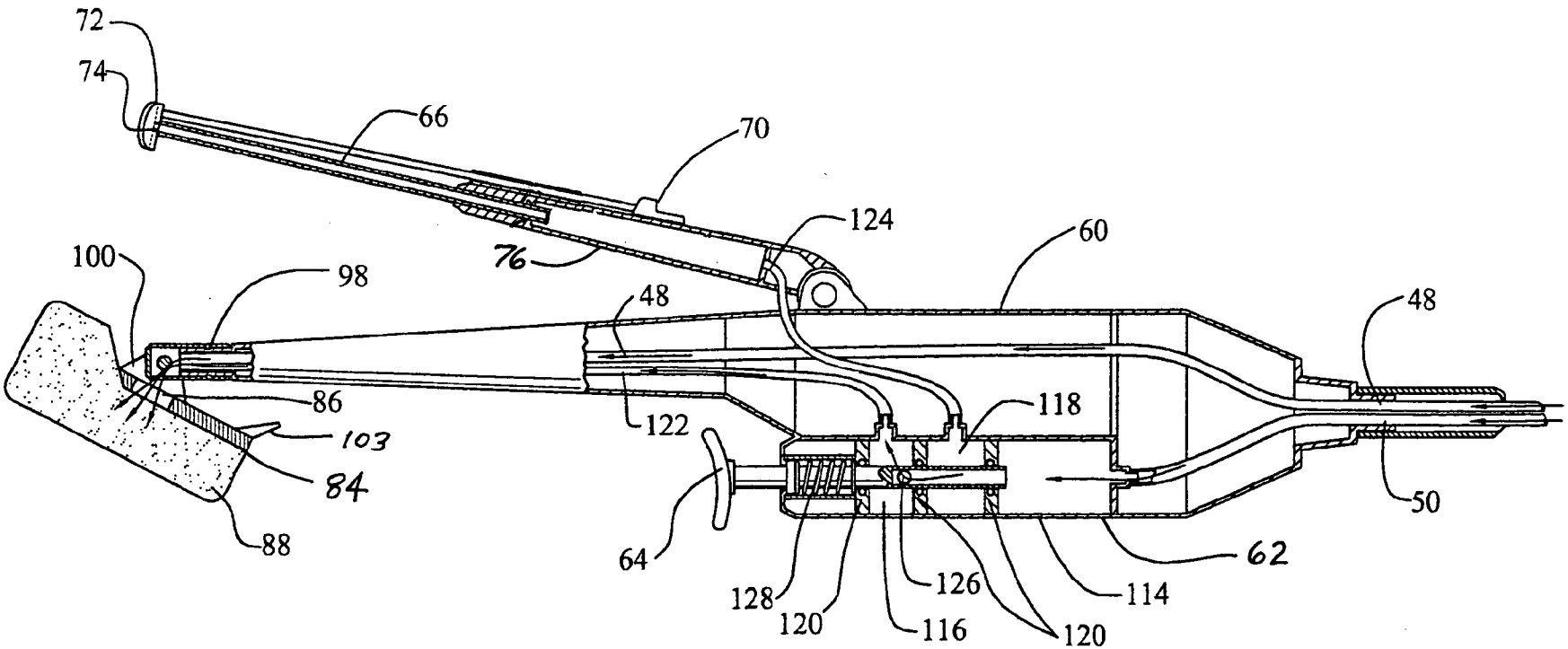
FIG. 4 is a side view, shown in partial cross section, illustrating the hand unit of FIG. 3 in a static configuration, and showing a hand unit soap line extending directly through the cleaning head extension bar, a first hot water line, and a second hot water line, and a trigger for controlling the flow of water to the cleaning head and rinse extension bar.
Figure 5:
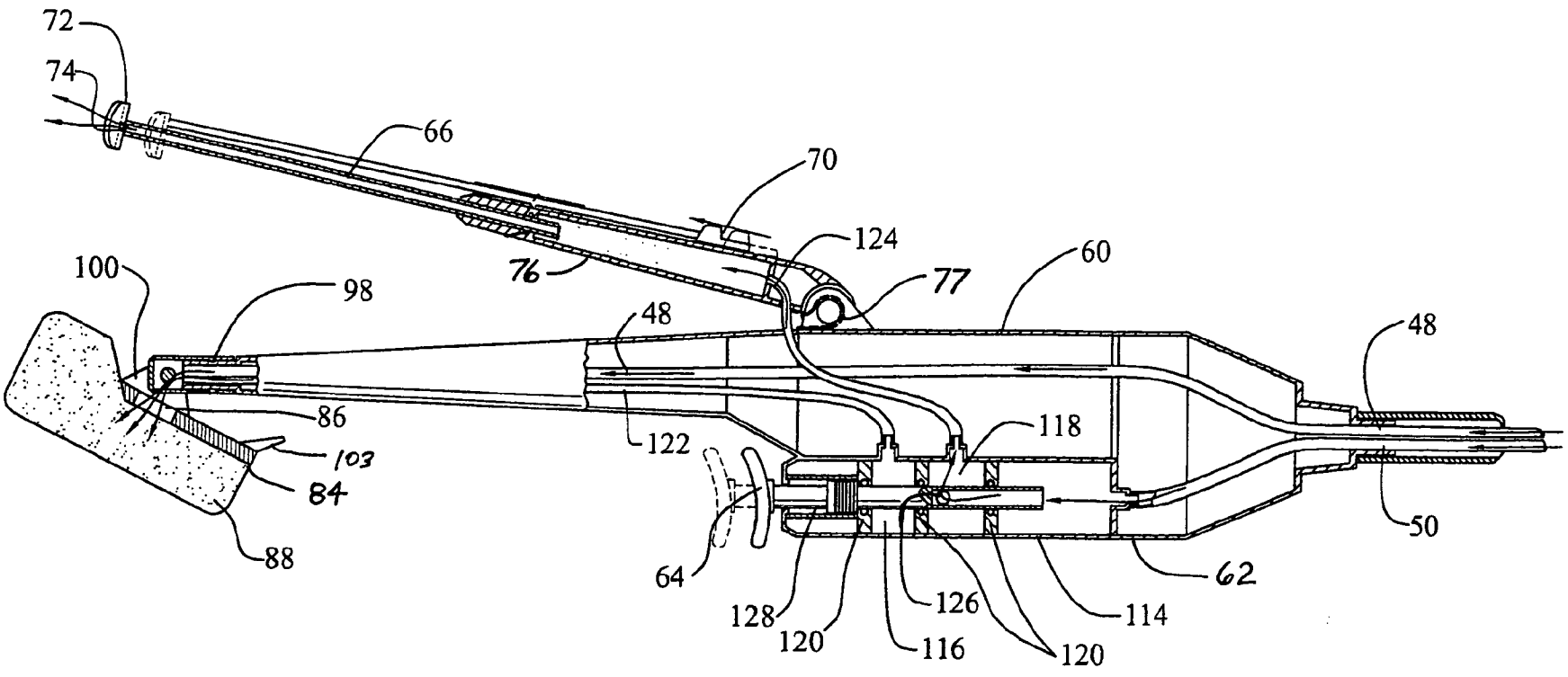
FIG. 5 is a side view, shown in partial cross section, illustrating the hand unit of FIG. 3, and showing movement of the rinse extension bar and operational movement of the trigger.

The hand unit connector tube 52 encases the hand unit soap line 48 and the hand unit water line 50 and extends from the base unit 20 to the hand unit 60. Referring to FIGS. 3-5, the hand unit soap line 48 and the hand unit water line 50 enter the hand unit 60, and the hand unit soap line 48 travels through the handle 62 and the cleaning head extension bar 78 of the hand unit 60, ending at the first reduced hole 80 (see FIG. 7), allowing the soap mixture 162 to exit onto the cleaning head 84.

Upon entering the hand unit 60, the hand unit water line 50 travels through the handle 62, ending at a hot water chamber 114 encased within the handle 62. The hot water chamber 114 is divided into separate chambers—a cleaning head hot water chamber 116 and a rinse extension hot water chamber 118—by spaced washers 120. A cleaning head hot water line 122 connects the cleaning head hot water chamber 116 with the second reduced hole 82 (see FIG. 7) for the hot water to exit onto the cleaning head 84. A rinse extension hot water line 124 connects the rinse extension hot water chamber 118 with the rinse tube water exit 74, located at the distal end of the rinse extension bar 66.

The trigger 64 controls whether water is taken from the cleaning head hot water chamber 116 or the rinse extension hot water chamber 118. When the trigger 64 is in a relaxed position, as illustrated in FIG. 4, water continuously flows from the cleaning head hot water chamber 116 to the cleaning head hot water line 122 via a hot water exit hole 126, and water is emitted from the reduced hole 82 onto the cleaning head 84. When the trigger 64 is depressed, as illustrated in FIG. 5, the hot water exit hole 126 is displaced, allowing water to continuously flow from the rinse extension hot water chamber 118 to the rinse extension hot water line 124, and water is emitted from the rinse tube water exit 74. When the trigger 64 is released, a spring 128 returns the trigger 64 to its relaxed position, as illustrated in FIG. 4.

A power cord 176 with accompanying power plug 178 extends out of the base unit 20, supplying power to the portable dishwashing apparatus 10. A water holding unit pump switch 172 is included within the base unit 20 for actuating water flow from the portable water holding tank 110 to the portable dishwashing apparatus 10, and is controlled by the water holding unit pump knob 36 located on the base unit 20. A heater unit power switch 174 controls the power supplied to the heater unit 142, and is regulated by the heater unit power knob 38 located on the base unit 20. A heating control switch 180, which is regulated by the heater unit control knob 34 located on the base unit 20, controls the temperature of the heater coils 144.

Figure 10:
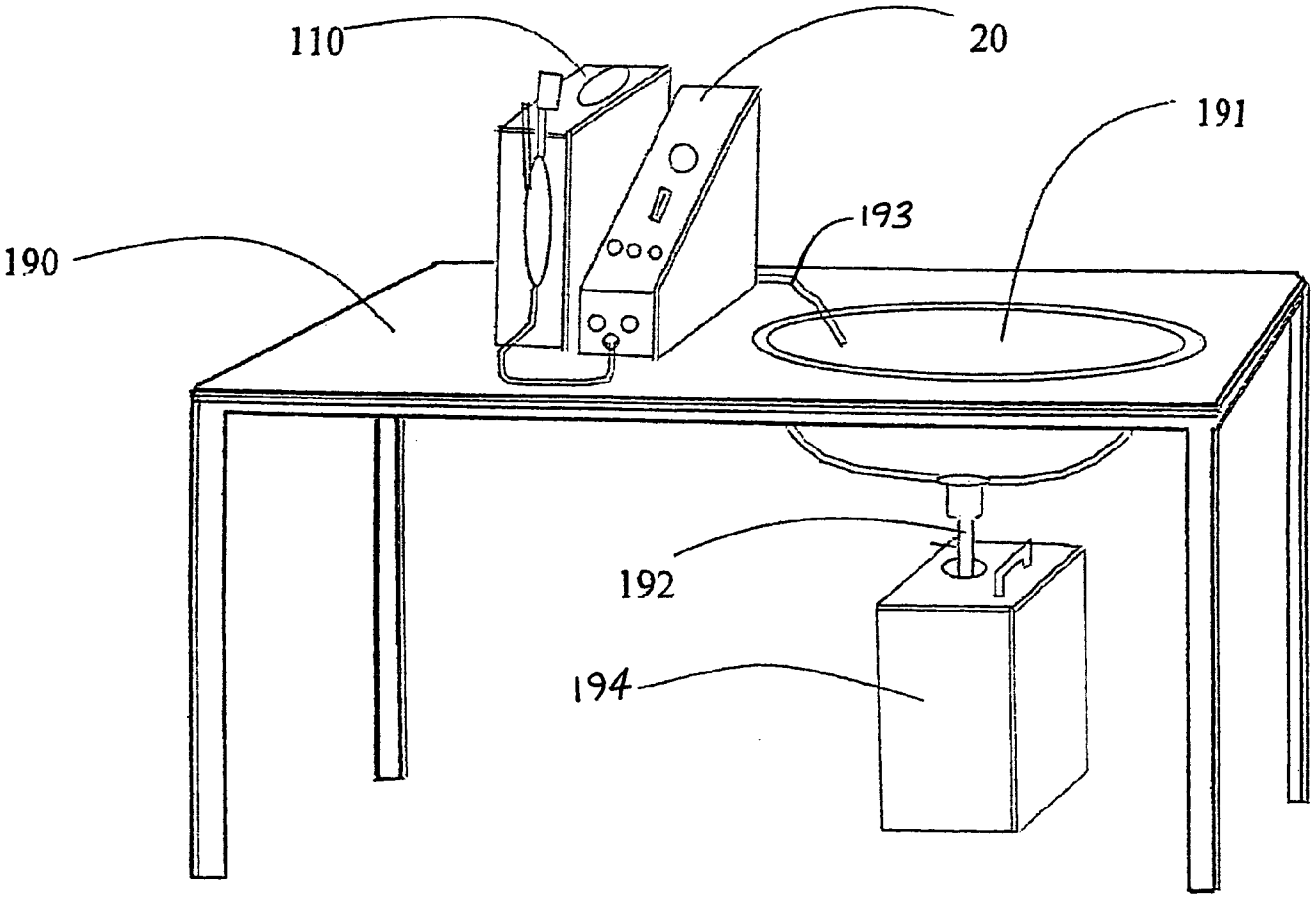
FIG. 10 is a perspective illustration showing the portable dishwashing apparatus of the present invention, and including a portable table unit upon which the portable dishwashing apparatus and portable water holding tank are supported, and further including a sink drain tube and a used water holding tank for storing excess soap mixture and water run-off.

As illustrated in FIG. 10, a portable table unit 190 having a sink unit 191 is used to support the base unit 20 and the portable water holding tank 110. The sink unit 191 further includes a sink drain tube 192 that is used to transport fluids received via the sink exit tube 193. The sink exit tube 193 receives excess soap mixture 162 via the soap drain tube 30, excess water run-off received via the hand unit drain tube 56, as well as water via the base unit overflow tube 57, to a used water holding tank 194. After the portable dishwashing apparatus has been used, the contents within the water holding tank 194 can easily be discarded by the user.

Figure 11:
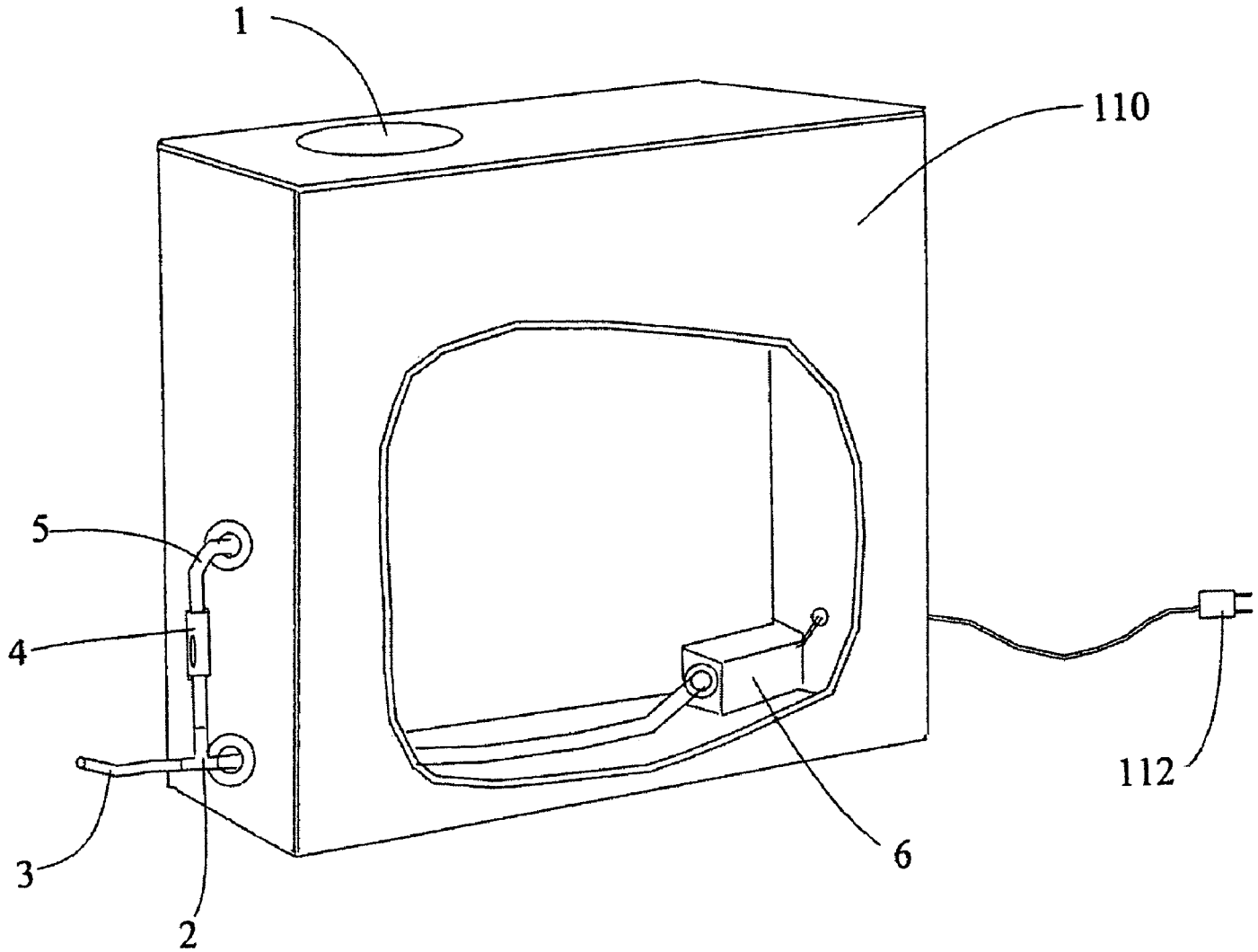
FIG. 11 is a partly cross-sectional perspective illustration of the water holding tank showing the internal water pump, the holding tank water supply line, the holding tank inlet, a T-splitter, and a relief valve knob.

Referring to FIG. 11, the water holding tank 110 includes a water fill hole 1 for refilling the water holding tank 110 with water. In operation, the water pump 6, which is powered by the water pump plug 112, pumps water through the holding tank water supply line 3, which is sized to fit the holding tank water inlet connection 24 located on the base unit. In the event of an excessive amount of water being supplied to the base unit 20, a holding tank inlet 5 is provided to return the excess water to the water holding tank 110. A T-splitter 2 connects the holding tank inlet 5 with the holding tank water supply line 3 and is controlled by a relief valve knob 4.

Figure 12:
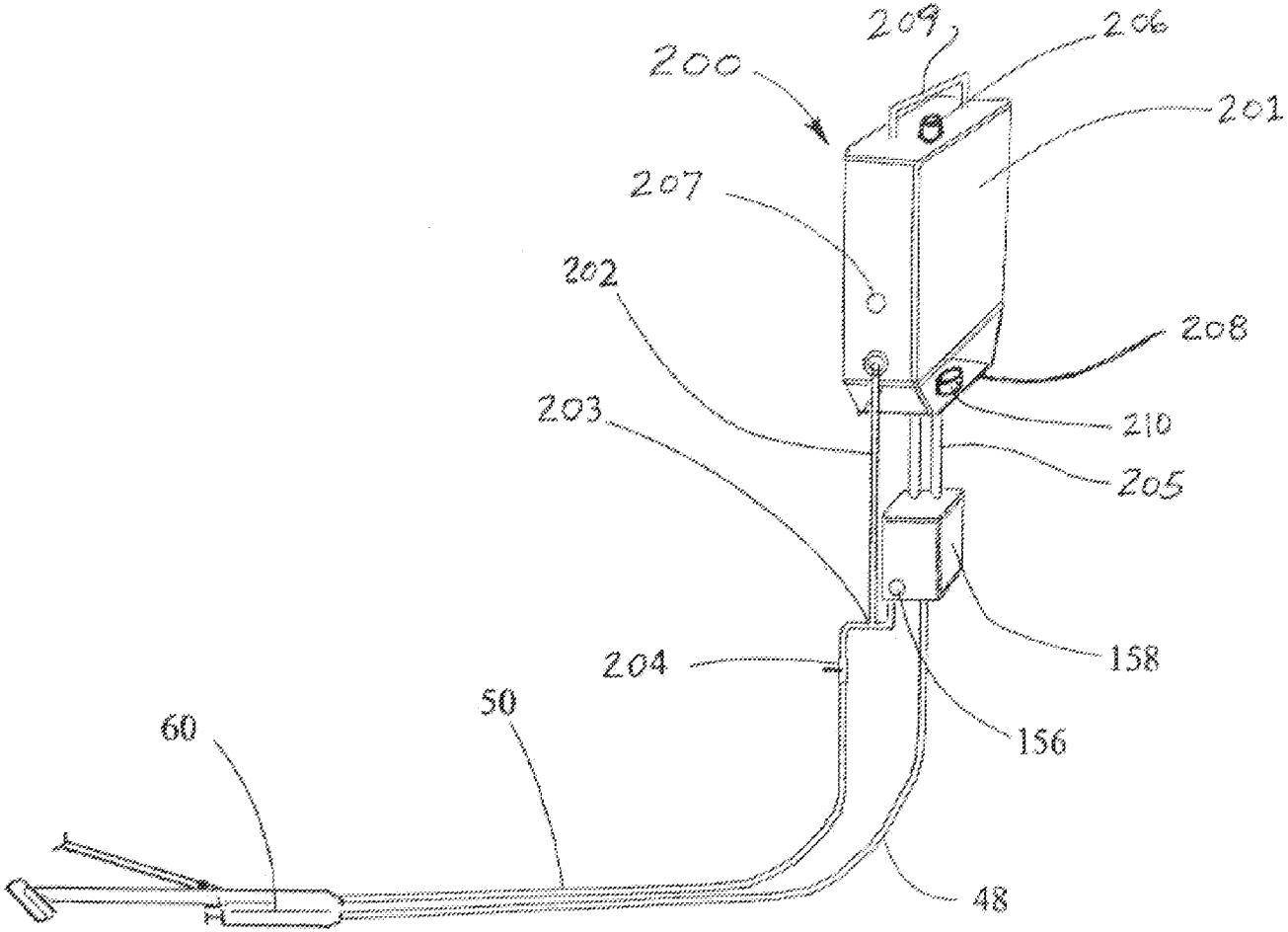
FIG. 12 is a perspective view of a further embodiment of the invention directed to a portable and easily transportable dishwashing apparatus that does not rely on a power source or a connection to conventional plumbing.

Referring to FIG. 12, a further embodiment of the portable dishwashing apparatus is shown and is generally indicated as 200. The portable dishwashing apparatus 200 in FIG. 12 is particularly adapted for use while camping or at remote locations where connection to electric power and conventional plumbing is not available or practical. The portable dishwashing apparatus 200, shown in FIG. 12, does not rely on use of electric power or connection to a water supply source, such as conventional plumbing. The portable dishwashing apparatus 200 includes an insulated water holding tank 201 that is filled by removing cap 206. The insulated water holding tank 201 can be filled from any water source, including a fresh water lake, river, stream, collected rain water, or from a hose or faucet. The insulated water tank 201 is intended to be held upright, as shown in FIG. 12 so that a shelf 208 is positioned below the water tank 201. The shelf 208 is adapted for holding one or more canned heat sources 210 of the type that are commonly used when camping. When activated, the canned heat source 210, positioned on the shelf 208, serves to heat the water contained in the tank 201. A temperature gauge 207 is provided to indicate the temperature of the heated water within the tank. A handle 209 on the top of the tank 201 allows for easy transport and hanging support of the apparatus when in use.

A general soap mixture tank 158, as described in connection with the embodiment of FIGS. 1-11, and as particularly shown in FIG. 6, is used in this embodiment of FIG. 12. The soap mixture tank 158 is connected to the shelf 208 and/or tank 201 of the apparatus 200 with the use connecting rods 205 or other suitable structure. A water exit tube 202 extends from a bottom of the water holding tank 201 and interconnects with hot water supply line 50 at a juncture with a line extending from soap chamber valve 156 on the soap mixture tank 158. A manually operated water flow valve 204 is provided inline along the hot water supply line 50 between hand unit 60 and the juncture of the water supply tube 202 and the line exiting the soap chamber valve 156. A separate soap line 48 extends from the soap mixture tank 158 to the hand unit 60 in the same manner as described in connection with the embodiment of FIGS. 1-11. The hand unit 60 is the same as described in connection with the embodiment of FIGS. 1-11, and as particularly shown and described in connection with FIGS. 1, 3-5 and 7-9.

While the present invention has been shown and described in accordance with several practical and preferred embodiments, it is recognized that departures from the instant disclosure are fully contemplated within the spirit and scope of the invention which is limited only by the following claims as interpreted by the Doctrine of Equivalents.

What is claimed is:

1. A portable dishwashing apparatus for cleaning dishes and utensils, said portable dishwashing apparatus comprising:

a heater unit structured and disposed for heating water received from a source of water delivering a pressurized flow of water;

a soap mixture tank structured and disposed for receiving the heated water and mixing the heated water with a charge of soap concentrate contained in said soap mixture tank to produce a soap mixture, wherein said soap mixture fills the soap mixture tank as the heated water enters the soap mixture tank;

a main line, defining a clean water tube, extending from said heater unit for receiving the pressurized flow of the heated water;

a second line, split from said main line and connecting to the soap mixture tank for delivering the pressurized flow of the heated water thereto to produce the soap mixture;

a soap exit tube extending from said soap mixture tank for receiving and transferring a flow of said soap mixture;

a hand unit connected to both said main line and said soap exit tube for independently receiving the pressurized flow of the heated water from said heater unit and the flow of said soap mixture from said soap mixture tank, said hand unit comprising:

a handle including a top end;

a first clean water discharge port in fluid flow communication with said main line and independent of said soap exit tube;

a second clean water discharge port in fluid flow communication with said main line and independent of said soap exit tube;

a trigger for selectively operating the pressurized flow of said heated water from said main line to either said first clean water discharge port for discharge therefrom or said second clean water discharge port for discharge therefrom;

at least one cleaning head component having a top side and a bottom side and being structured and disposed for scrubbing dishes and utensils, and said at least one cleaning head component being rotatable and pivotable relative to said handle;

a soap mixture discharge port in communication with said soap exit tube and independent of said first clean water discharge port and said second clean water discharge port, and said soap mixture discharge port being structured and disposed for emitting said soap mixture onto said at least one cleaning head component;

a cleaning head extension bar extending from the top end of said handle and having a distal end, and wherein said first clean water discharge port and said soap mixture discharge port are located at the distal end of said cleaning head extension bar;

a rinse extension bar extending from the top end of said handle and having a distal end, and wherein said second clean water discharge port is located at the distal end of said rinse extension bar;

said rinse extension bar being structured and disposed for pivotal movement relative to said handle of said hand unit and said at least one cleaning head component to engage said distal end with said at least one cleaning head component for holding said at least one cleaning head component and preventing rotational or pivotal movement of said at least one cleaning head component, thereby allowing for selective use of one of either the top or bottom sides of said at least one cleaning head component;

a first flow rate valve for independently and directly controlling the rate of flow of the pressurized flow of the heated water through said main line and to said hand unit; and a second flow rate valve for independently and directly controlling the rate of flow of said soap mixture through said soap exit tube.

2. The apparatus as recited in claim 1 wherein said distal end of said rinse extension bar is extendable and retractable relative to said handle of said hand unit and said at least one cleaning head component.

3. The apparatus as recited in claim 1 wherein said at least one cleaning head component includes a sponge material for scrubbing and wiping.

4. The apparatus as recited in claim 1 wherein said top side of said at least one cleaning head component includes an array of scrubbing bristles.

5. The apparatus as recited in claim 1 wherein said at least one cleaning head component includes a scraping element.

6. A portable dishwashing apparatus for cleaning dishes and utensils, said portable dishwashing apparatus comprising:

a base unit having a top side, a bottom side, a front end, and a rear end, and said base unit being structured and disposed for receiving water from a source of water;

a soap tank for holding a charge of soap;

a main line, defining a clean water tube, for receiving a flow of the water;

a soap exit tube extending from said soap tank for receiving and transferring a flow of the soap;

a hand unit connected to both said main line and said soap exit tube for independently receiving the pressurized flow of water and the flow of soap comprising:

a handle including a top end;

a first clean water discharge port in fluid flow communication with said main line and independent of said soap exit tube;

a second clean water discharge port in fluid flow communication with said main line and independent of said soap exit tube;

a trigger for selectively operating the pressurized flow of said water from said main line to either said first clean water discharge port for discharge therefrom or said second clean water discharge port for discharge therefrom;

at least one cleaning head component having a top side and a bottom side and being structured and disposed for scrubbing dishes and utensils, and wherein said at least one cleaning head component is further structured for allowing pivotal movement relative to the top end of said handle;

a soap discharge port in communication with said soap exit tube and independent of said first clean water discharge port and said second clean water discharge port, and said soap discharge port being structured and disposed for emitting said soap onto said at least one cleaning head component;

a first flow rate valve for independently and directly controlling the rate of flow of the pressurized flow of the water through said main line and to said hand unit; and a second flow rate valve for independently and directly controlling the rate of flow of said soap through said soap exit tube.

7. The apparatus as recited in claim 6 further comprising a cleaning head extension bar extending from the top end of said handle and having a distal end, and wherein said first clean water discharge port and said soap discharge port are located at the distal end of said cleaning head extension bar.

8. The apparatus as recited in claim 6 further comprising a rinse extension bar extending from the top end of said handle and having a distal end, and wherein said second clean water discharge port is located at the distal end of said rinse extension bar.

9. The apparatus as recited in claim 8 wherein said distal end of said rinse extension bar is extendable and retractable relative to said handle of said hand unit and said at least one cleaning head component.

10. The apparatus as recited in claim 8 wherein said rinse extension bar is pivotally movable relative to said handle of said hand unit and said at least one cleaning head component, and wherein said at least one cleaning head component may be held in position by said rinse extension bar for selectively operating one of either the top or bottom sides of said at least one cleaning head component.

11. The apparatus as recited in claim 6 further comprising a heat source for heating said water.

12. The apparatus as recited in claim 6 wherein said distal end of said rinse extension bar is extendable and retractable relative to said handle of said hand unit.

13. The apparatus as recited in claim 6 wherein said at least one cleaning head component includes a sponge material for scrubbing and wiping.

14. The apparatus as recited in claim 6 wherein said top side of said at least one cleaning head component includes an array of scrubbing bristles.

15. The apparatus as recited in claim 6 wherein said at least one cleaning head component includes a scraping element.

16. A portable dishwashing apparatus for cleaning dishes and utensils, said portable dishwashing apparatus comprising:

a heater unit structured and disposed for heating water received from a source of water delivering a pressurized flow of water;

a soap mixture tank structured and disposed for receiving the heated water and mixing the heated water with a charge of soap concentrate contained in said soap mixture tank to produce a soap mixture, wherein said soap mixture fills the soap mixture tank as the heated water enters the soap mixture tank;

a main line, defining a clean water tube, extending from said heater unit for receiving the pressurized flow of the heated water;

a second line, split from said main line and connecting to the soap mixture tank for delivering the pressurized flow of the heated water thereto to produce the soap mixture;

a soap exit tube extending from said soap mixture tank for receiving and transferring a flow of said soap mixture;

a hand unit connected to both said main line and said soap exit tube for independently receiving the pressurized flow of the heated water from said heater unit and the flow of said soap mixture from said soap mixture tank, said hand unit comprising:

a handle including a top end;

a first clean water discharge port in fluid flow communication with said main line and independent of said soap exit tube;

a second clean water discharge port in fluid flow communication with said main line and independent of said soap exit tube;

a trigger for selectively operating the pressurized flow of said heated water from said main line to either said first clean water discharge port for discharge therefrom or said second clean water discharge port for discharge therefrom;

at least one cleaning head component having a top side and a bottom side and being structured and disposed for scrubbing dishes and utensils, and said at least one cleaning head component being pivotable relative to said handle;

a soap mixture discharge port in communication with said soap exit tube, and said soap mixture discharge port being structured and disposed for emitting said soap mixture onto said at least one cleaning head component;

a first flow rate valve for independently and directly controlling the rate of flow of the pressurized flow of the heated water through said main line and to said hand unit; and a second flow rate valve for independently and directly controlling the rate of flow of said soap mixture through said soap exit tube.

17. The apparatus as recited in claim 16 further comprising a cleaning head extension bar extending from the top end of said handle and having a distal end, and wherein said first clean water discharge port and said soap mixture discharge port are located at the distal end of said cleaning head extension bar.

18. The apparatus as recited in claim 16 further comprising a rinse extension bar extending from the top end of said handle and having a distal end, and wherein said second clean water discharge port is located at the distal end of said rinse extension bar, and wherein said rinse extension bar is pivotally movable relative to said handle of said hand unit and said at least one cleaning head component.

19. The apparatus as recited in claim 18 wherein said rinse extension bar is structured and disposed for pivotal movement relative to said handle of said hand unit and said at least one cleaning head component to engage said distal end with said cleaning head component for holding said at least one cleaning head component and preventing pivotal movement of said at least one cleaning head component, thereby allowing for selective use of one of either the top or bottom sides of said at least one cleaning head component.

20. The apparatus as recited in claim 18 wherein said distal end of said rinse extension bar is extendable and retractable relative to said handle of said hand unit and said at least one cleaning head component.

* * * * *